US005165438A

United States Patent [19]

Facteau et al.

[11] Patent Number: 5,165,438

[45] Date of Patent: Nov. 24, 1992

[54] FLUIDIC OSCILLATOR

[76] Inventors: David M. Facteau, 2601 Emerson, Midland, Tex. 79705; Timothy A. Cobb, 1416 Sierra Springs, #1815, Bedford, Tex. 76021; Michael D. Hyman, 2206 Madera, Odessa, Tex. 79763

[21] Appl. No.: 887,848

[22] Filed: May 26, 1992

[51] Int. Cl.[5] ..... E03B 1/00; F15C 1/08

[52] U.S. Cl. ..... 137/1; 137/811; 137/825; 137/826

[58] Field of Search ..... 137/810, 811, 833, 825, 137/826, 1

[56] References Cited

U.S. PATENT DOCUMENTS

| | | | |
|---|---|---|---|
| 4,041,984 | 8/1977 | Morel | 137/842 |
| 4,231,519 | 11/1980 | Bauer | 137/826 |
| 4,276,943 | 7/1981 | Holmes | 137/810 |
| 5,035,361 | 7/1991 | Stouffer | 137/826 |

FOREIGN PATENT DOCUMENTS

| | | | |
|---|---|---|---|
| 1343403 | 1/1974 | United Kingdom | 137/825 |

*Primary Examiner*—A. Michael Chambers

*Attorney, Agent, or Firm*—Dodge, Bush, Moseley & Riddle

[57] ABSTRACT

In accordance with an illutrative embodiment of the present invention, a fluidic oscillator includes a transverse vacuum port which extends between the diffuser legs a predetermined distance below the leading edge surface of the splitter. When flow is down one leg, a slight negative pressure condition is created in the port and transmitted thereby to the other leg, which causes switching of the flow to such other leg. The process then repeats in response to negative pressure in the one leg to cause switching of the flow back thereto. Fluid flow thus is switched back and forth between the legs at a resonant frequency, so that continuously fluctuating pressures are applied to the surrounding medium.

10 Claims, 1 Drawing Sheet

FIG. 1
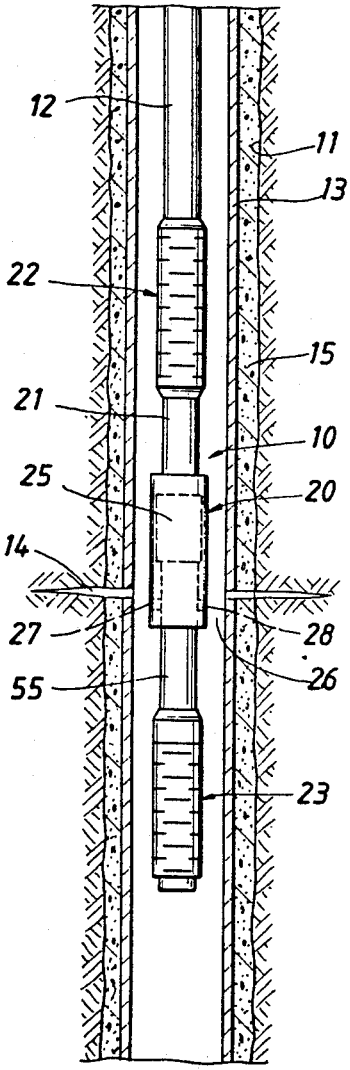
FIG. 2
(PRIOR ART)
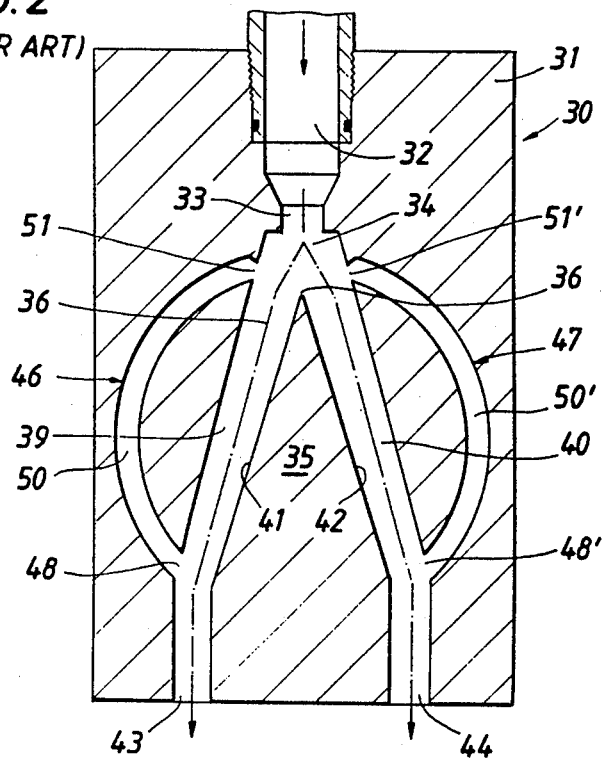
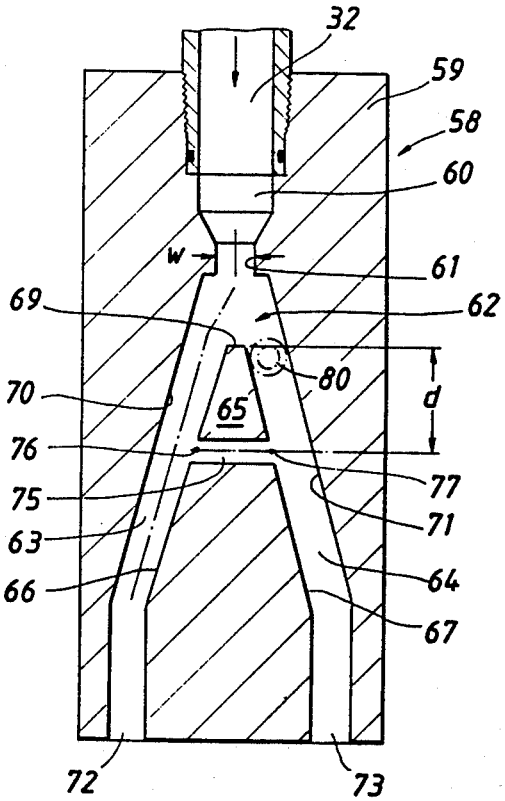
FIG. 3

FLUIDIC OSCILLATOR

FIELD OF THE INVENTION

This invention relates generally to a new and improved fluidic oscillator or switch, and particularly to a fluidic oscillator or switch having a unique port arrangement in which vacuum or negative pressure conditions are created which cause fluid flow to automatically switch from one diffuser leg to another in a continuous cyclical manner.

BACKGROUND OF THE INVENTION

A typical fluidic oscillator includes a block or body which defines a power nozzle that produces a fluid jet. The jet is directed through a chamber toward the upstream edge of a flow splitter that forms the inner walls of a pair of oppositely inclined diffuser legs. The outer walls of the legs are formed by the body, and each leg leads to an outlet port. The jet will oscillate back and forth between the legs, rather than sticking to the walls of one of them, if so-called "spoiler" passages are used which extend from near the lower end of each leg to a respective side of the chamber. When the main jet flows through one of the legs, the spoiler passage for that leg feeds back some of the flow which enters the side of the chamber transversely and causes the main jet to switch over to the other leg. Then the spoiler passage on that side creates an opposite transverse flow into the side of the chamber, which switches the main jet flow back to the first leg. The switching occurs on a cyclical basis as a certain frequency. However, the spoiler passages that have been used are relatively long looping paths in the body which are difficult and expensive to manufacture, and most any structural defect therein will cause instability in the switching action and the frequency of operation of the transducer.

One object of the present invention is to provide a fluidic oscillator having new and improved means to cause stable switching.

Another object of the present invention is to provide a new and improved fluidic oscillator that uses a vacuum or negative pressure effect which pulls the jet back and forth across the upstream edge surface of the splitter to produce switching.

Still another object of the present invention is to provide a new and improved fluidic oscillator which eliminates the use of feedback loops and thus reduces size and manufacturing costs, and simplifies construction, while providing improved frequency stabilization.

SUMMARY OF THE INVENTION

These and other objects are attained in accordance with the concepts of the present invention through the provision of a fluidic oscillator comprising an inlet passage that leads to a main jet nozzle which preferably is rectangular or square in cross-section. The flow out of the nozzle is directed against the leading edge surface of a splitter whose oppositely inclined sidewalls form the respective inner walls of first and second diffuser legs or passages. The lower ends of the legs are connected to respective outlet ports. To prevent the main jet from locking onto the wall surfaces of one of the diffuser legs, a transverse vacuum port is formed in the splitter at a predetermined distance below the leading edge surface thereof. As the jet flows down one of the legs past an end of the vacuum port, a slight vacuum or negative pressure condition is created in the port which is transmitted by the opposite end of the port to the other leg. Such negative pressure first dissipates a vortex that is formed at the upper end of this leg by the edge of the main jet peeling off the leading edge surface of the splitter. Then the negative pressure condition causes the main jet stream to be pulled across the leading edge surface of the splitter and into the other leg. A negative pressure condition then is created in the vacuum port by flow through this leg past the said opposite end of the port, and such negative pressure is transmitted to the other leg to dissipate the vortex that will have formed at its upper end. Then the negative pressure conditions pulls the jet back across the leading edge surface of the splitter and into the first leg. The same phenomenon occurs again and again to automatically switch the fluid jet back and forth between the legs, in continuous cycles. For a selected steady flow rate through the inlet passage and nozzle, the flow switching generates pressure fluctuations in the medium outside the outlet ports which can be employed for a variety of purposes. The distance between the transverse axis of the vacuum port and the leading edge surface of the splitter is specifically dimensioned to create the negative pressure effect. The present invention enables the size of the oscillator block to be reduced substantially, and makes the oscillator much easier to manufacture, at considerably reduced costs. The unique oscillator construction also operates with improved frequency stability.

BRIEF DESCRIPTION OF THE DRAWINGS

The present invention has other objects, features and advantages as will become more apparent in connection with the following detailed description of a preferred embodiment, taken in conjunction with the appended drawings in which:

FIG. 1 is schematic view of a well operation using a fluidic oscillator in accordance with this invention;

FIG. 2 is a cross-sectional view of a conventional fluidic oscillator (prior art); and FIG. 3 is a cross-sectional view of a new and improved fluidic oscillator that is constructed in accordance with the concepts of the present invention.

DETAILED DESCRIPTION OF A PREFERRED EMBODIMENT

Referring initially to FIG. 1, a well tool 10 is shown suspended in a well bore 11 on a running string 12 of tubing, or the like. In a well operation such as perforation cleaning, the well bore 11 is lined with casing 13 which has been cemented at 15 and then perforated at 14 in order to communicate the bore of the casing with the earth formations which surround it. Where the well tool 10 is used in connection with the drilling of a well bore, for example to increase the rate of penetration of the bit, of course the casing 13 would not yet have been installed. Although the present invention will be described mainly in connection with perforation cleaning, it will be recognized that the invention can be used in other well applications such as drilling, and in numerous industrial applications such as pneumatic tools and the like.

For purposes of the following description, the well tool 10 includes a generally tubular oscillator sub 20 which is a part of an elongated body 21 that can carry filters 22 and 23 at its upper and lower ends. An oscillator block 25 shown in phantom lines in FIG. 1 is mounted in a companion cavity inside the sub 20, and is supplied with a selected flow rate of fluid under pressure through the tubing string 12 from the surface. The oscillator 25 functions to generate pressure fluctuations at a predetermined frequency which are applied to the fluids in the well annulus 26 outside the sub 20 through outlet ports 27, 28. Such pressure fluctuations can, for example, have a peak-to-peak value in the order of 2,000 psi, and a frequency of from 180–190$H_z$, so that an exemplary standing or hydrostatic head pressure of 2,500 psi at the depth of the tool 10 is made to vary between about 1,500 psi and 3,500 psi. The pressure fluctuations create alternating compression and tension loads on anything in the vicinity of the oscillator sub 20, for example the material that may be plugging the walls of the perforations 14 and reducing the productivity of the well. The cyclical loading causes disintegration of such material so that it can be flushed out of the perforation tunnels by formation pressure. The filters 22 and 23, which can take the form of elongated tubes having angularly spaced rows of transverse slots formed therein, substantially confine the pressure fluctuations to that section or interval of the well bore between them. The slots provide a resistance in the hydraulic circuit which breaks up the pressure waves at their respective locations. Of course the filters 22 and 23 do not stop the flow of fluid up the annulus between the tubing 12 and the casing 13 so that fluids pumped down the tubing and the oscillator sub 20 can return to the surface in a circulating manner.

For purposes of comparison, the typical fluidic oscillator is shown at 30 in FIG. 2. The oscillator 30 includes a block 31 which can be formed in two confronting halves that are joined together by any suitable means. The block 31 has an entry flow port 32 at its upper end which leads to a power or jet nozzle 33. The nozzle 33 typically has a square or rectangular cross-section. A chamber 34 is formed below the nozzle 33 and above a splitter 35 which has an edge 36 at its upper end. The splitter 35 is symmetrically arranged so that its upper edge 36 is longitudinally aligned with the central axes of the nozzle 33 and the inlet passage 32. Diffuser passages or legs 39, 40 extend downward along the respective oppositely inclined side walls 41, 42 of the splitter 35, and lead to respective outlet ports 43, 44 which communicate with the environment outside the sub 20. Since the so-called "Coanda" effect will tend to make the main jet coming out of the nozzle 33 and passing through the chamber 34 lock or stick to the walls of one of the legs 39, 40, rather than being actually divided by the splitter 35, spoiler or pressure feed-back passages 46, 47 are provided to cause switching. The passages 46, 47 have lower ends 48, 48' that communicate respectively with the legs 39 and 40 near the lower end thereof, and extend upwardly in looping paths 50, 50' to nozzles 51, 51' which are arranged to issue switching jets laterally into the sides of the chamber 34. When the main jet is flowing, for example, down the leg 39 as shown in a dash-dot-dash line, the port 48 channels a part of the flow back upward through the passage 46 so that a small transverse jet which issues from the nozzle 51 impinges against the side on the main jet flowing downward in the chamber 34. Such impingement, and the resulting disturbance, deflects the main jet across the leading edge 36 of the splitter 35 so that it crosses over to the other leg 40 where it flows downward therein as shown by the dash line. The same action then occurs through the spoiler passage 47 to deflect the jet flow back over into the leg 39. Thus, the main jet can be made to switch back and forth between the legs 39, 40 at a selected resonant frequency, depending upon design parameters, so long as a steady rate of flow is supplied to the power nozzle 33 via the entry passage 32.

Another device which is a fluidic amplifier and operates in an entirely different way to achieve an entirely different result from the present invention is illustrated in Warren U.S. Pat. No. 3,397,713. Here a passage that extends laterally through the splitter feeds back a part of the flow down one leg to the other leg to stabilize the flow down said one leg. The flow that is fed back is said to limit excessive back pressure in order to achieve a stabilizing function so that no switching occurs unless and until a separate fluid flow is applied to a control nozzle unit. Thus the Warren amplifier seeks to obtain more forceful attachment of the jet flow to a respective leg until a control nozzle signal is applied. Using a splitter-to-nozzle ratio expressed as L/W, where L is the distance from the nozzle outlet to the leading edge of the splitter, and W is the width of the nozzle outlet, the Warren device would need a ratio greater than 5 for proper operation. Since a greater attachment of the jet to a leg is sought in the operation of the Warren device, this concept is essentially the opposite of the present invention where negative pressure conditions are created in a transverse passageway which cause switching, rather than reinforcement of wall attachment.

As shown in FIG. 3, the present invention includes a block 59 which forms a fluidic oscillator 58 has a fluid entry path 60 that leads to a nozzle 61. The nozzle 61 preferably is square in cross-section. The main jet which issues from the nozzle 61 enters a chamber 62 located at the upper end of a pair of diffuser legs 63, 64 which incline downward and outward in opposite directions. The inner walls 66, 67 of the legs 63, 64 define the opposite side walls of a generally wedge-shaped splitter 65 which has a narrow edge surface 69 at its upstream end. The edge surface 69 has a width dimension which is used in determining other dimensional aspects of the invention as set forth below. The outer sides 70, 71 of the legs 63, 64 also are formed parallel to inner side walls 66, 67. Outlet ports or passages 72, 73 which communicate with the respective lower ends of the legs 63, 64 lead to the environment in which the oscillator is used.

In lieu of the upwardly looping spoiler passage 46, 47 to cause switching as shown in FIG. 2, the present invention employs a transverse passageway 75 which is formed to extend through the body of the splitter 65 in a manner such that its opposite ends 76, 77 are in communication with the respective diffuser legs 63, 64. The passageway 75, whose longitudinal axis X is located a predetermined distance d below the upper edge surface 69 of the splitter 65, functions in the nature of a vacuum port in that high velocity flow past either of its ends 76 or 77 creates a negative pressure condition in whichever leg is opposite to the leg through which the main jet is flowing. Such alternating negative pressure conditions causes the main jet flowing downward in the chamber 62 to be switched back and forth between the diffuser legs 63, 64 and thereby create pressure fluctuations which are transmitted to the surrounding medium by the outlet ports 72, 73. As distinguished from the above-mentioned Warren device, the splitter-to-nozzle ratio of the present invention is less than 2, so that fluid attachment to the walls of the diffuser legs 63, 64 is not positively promoted. Further details of the operation of the present invention, and a formula for determining the distance d, are set forth below.

OPERATION

When the present invention is used in connection with a well tool such as the perforation cleaning device 10, fluid under pressure is pumped down the tubing 12 at a selected rate, for example at about 1.5 barrels per minute. The flow goes through a central passage (not shown) in the upper part of the tool body 21 and through the inlet port 60 in the oscillator block 59 where it is accelerated through the jet nozzle 61 into the chamber 62. However, instead of being split in half by the splitter 65, most of the jet flow tends to lock onto one of the diffuser legs 63 or 64, for example the leg 63 as shown in FIG. 3, where it exits via the outlet port 72. As the jet flows down the leg 63, a part thereon is peeled off by the leading edge surface 69 of the splitter 65 and forms a vortex 80 at the upper end of the opposite leg 64. This flow condition will tend to remain unchanged unless and until the fluid jet is disturbed enough to make it switch over to the other diffuser leg 64.

In response to flow of the main jet stream down the leg 63, a slight vacuum or negative pressure condition is created in the port 75 which is communicated to the other diffuser leg 64 by the opposite end 77 thereof. This negative pressure condition first dissipates the vortex 80, and then pulls the jet stream across the leading edge surface 69 and causes it to be diverted or switched over into the leg 64 where it exits via outlet 73. Then a vortex like 80 will form near the upper end of diffuser leg 63 by reason of the same effect mentioned above. However, the slight negative pressure condition created by flow down leg 64 past the end 77 of the passage 75 is communicated to the leg 63 and dissipates this vortex, after which the negative pressure condition pulls the jet stream back across the edge surface 69 of the splitter 65 so that the main flow is down the leg 63 and out the exit port 72. With a steady rate of fluid flow supplied to the inlet passage 60, the switching will occur in a continuous and cyclical manner that produces pressure fluctuations or waves in the well annulus which can have a peak-to-peak value and a resonate frequency noted above.

In accordance with an important aspect of the present invention, the longitudinal axis of the vacuum passage 75 is located a certain distance d below the leading edge surface 69 of the splitter 65. It has been determined that the distance d can be calculated as follows:

$$d = 11.11\ (^{w}s/2)$$

where:

d is the distance from the leading edge surface 69 of the splitter 65 to the axis X of the passage 75;

and $^{w}s$ is the width of the edge surface 69 of the splitter 65.

Moreover, the angles of the walls 41, 42 with respect to the central axes of the nozzle 61 and the inlet 60 should be in the range of from 15°–28°.

The pressure pulsations generated in the adjacent medium by the oscillator 58 can be used in many ways. For example where the tool 10 is used for cleaning perforations which extend through the wall of the casing 11 and out into the surrounding earth formation, the pressure fluctuations cause cyclically changing compression and tension loading to be applied to any material that may be plugging or partially blocking the perforations or their walls. As a result, the material is disintegrated so that formation pressure and flow can flush the debris out in the well bore. When the tool is used in connection with drilling, the hold-down forces on rock chips due to the hydrostatic head of the drilling mud are effectively reversed during each negative-going portion of each pressure fluctuation. During each reduced pressure phase, the chips are propelled upward into the mud circulation by formation pressure to increase the rate of penetration of the bit. The structure and principles of operation of the present invention also are applicable to various pneumatic tools which operate through vibratory motion, as well as many other industrial applications. Thus the disclosure of the present invention in connection with a well tool is to be considered as merely exemplary, and not in a limitative sense.

It now will be recognized that a new and improved fluidic oscillator apparatus has been disclosed which includes a transverse vacuum port or passage in the splitter that creates negative pressure conditions and causes oscillatory switching of a fluid jet between the legs and outlet ports of the apparatus. Since certain changes or modifications may be made in the disclosed embodiment without departing from the inventive concepts involved, it is the aim of the appended claims to cover all such changes and modifications falling within the true spirit and scope of the present invention.

What is claimed is:

1. A method of generating pulsating fluid pressures that are applied to an environment, comprising the steps of: flowing fluid through a nozzle which forms a fluid jet in a chamber adjacent said nozzle; providing a flow splitter on the opposite side of said chamber from said nozzle, said splitter having a leading edge surface that is aligned with the flow axis of said jet; providing a pair of oppositely inclined diffuser passages which communicate with said chamber and with respective outlet ports; providing an elongated vacuum port having its ends in communication with respective ones of said diffuser passages at locations downstream of said leading edge surface; and using the flow of said fluid jet through one of said diffuser legs to create a negative pressure condition in said port which is communicated to the other of said diffuser legs, said negative pressure condition causing switching of said fluid jet from said one diffuser leg to said other diffuser leg.

2. The method of claim 1 including the further steps of using the flow of said fluid jet through said other diffuser leg to create a negative pressure condition in said port which is communicated to said one diffuser leg, said negative pressure condition causing switching of said fluid jet from said other diffuser leg back to said one diffuser leg.

3. The method of claim 2 including the step of locating the axis of said elongated vacuum port with respect to said edge surface of said flow splitter at a distance which is proportional to the width of said edge surface.

4. The method of claim 3 wherein said distance is calculated according to the following formula: $d = 11.11\ (^{w}s/2)$ where d is said distance and $^{w}s$ is the width of said edge surface.

5. The method of claim 1 including the further steps of inclining each of said diffuser passages with respect to the axial centerline of said nozzle at an angle that is in the range of from 15°–28°.

6. In a fluidic oscillator that includes a body forming a jet nozzle, a chamber adjacent said nozzle, flow splitter means having a leading edge surface that is longitudinally aligned with said jet nozzle, a pair of oppositely inclined flow passages on the opposite sides of said splitter means, and an outlet port in communication with each of said flow passages, transversely arranged vacuum port means in said splitter means having opposite ends, one of said ends being in communication with a respective one of said flow passages for creating negative pressure conditions in the other of said flow passages when the fluid jet produced by said nozzle is flowing through said one passage and past said end of said port means, said port means being located beyond said leading edge surface of said splitter means at a distance which is proportioned to the width of said leading edge surface.

7. The oscillator of claim 6 wherein the ratio of the distance between said leading edge surface and the outlet of said jet nozzle, and the width of said outlet nozzle, is less than about 2.

8. The oscillator of claim 7 wherein the angle between each of said flow passages and the axial centerline of said nozzle is in the range of from 15°–28°.

9. The oscillator of claim 6 wherein said vacuum port means has a longitudinal axis, and wherein said axis is located beyond said edge surface of said splitter means at a distance which is proportioned to the width of said edge surface.

10. The oscillator of claim 9 wherein said distance is calculated according to the following formula:

$$d = 11.11\ (w_s/2)$$

where d is said distance; and $w_s$ is the width of said edge surface.

* * * * *